US005775398A

United States Patent [19]

Siegel

[11] Patent Number: 5,775,398

[45] Date of Patent: Jul. 7, 1998

[54] CARD HOLDER

[75] Inventor: Milton I. Siegel, Scottsdale, Ariz.

[73] Assignee: Helen P. Siegel, Scottsdale, Ariz.

[21] Appl. No.: 499,795

[22] Filed: Jul. 7, 1995

Related U.S. Application Data

[62] Division of Ser. No. 871,195, Apr. 20, 1992, Pat. No. 5,431,207.

[51] Int. Cl.[6] ..... A45C 1/06; A45C 11/18

[52] U.S. Cl. ..... 150/139; 150/145; 150/147

[58] Field of Search ..... 150/132, 133, 150/138, 145, 147, 148, 139; 206/450, 39.5

[56] References Cited

U.S. PATENT DOCUMENTS

| | | | |
|---|---|---|---|
| 460,472 | 9/1891 | Hitt | 206/450 |
| 1,670,343 | 5/1928 | Clemens | 206/39.5 |
| 1,791,703 | 2/1931 | Benedict et al. | 150/138 X |
| 1,896,573 | 2/1933 | Buxton | 206/450 X |
| 2,439,715 | 4/1948 | Broughton | 150/145 X |
| 2,451,122 | 10/1948 | Sherwood | 150/145 X |
| 2,477,840 | 8/1949 | Vasilas | 150/145 X |
| 2,589,667 | 3/1952 | Broughton | 150/147 |
| 2,606,589 | 8/1952 | Linehan | 150/145 X |
| 2,674,290 | 4/1954 | St. Thomas | 150/147 |
| 2,718,911 | 9/1955 | Solomon | 150/147 |
| 2,732,874 | 1/1956 | Carstensen | 150/147 |
| 2,732,875 | 1/1956 | Martin | 150/147 |
| 2,763,311 | 9/1956 | Sparrow | 150/147 |
| 2,767,756 | 10/1956 | Niles | 150/147 |
| 2,815,786 | 12/1957 | Robinson | 150/139 X |
| 3,067,792 | 12/1962 | Broughton | 150/148 X |
| 3,241,588 | 3/1966 | Osher et al. | 150/147 |
| 3,267,980 | 8/1966 | Bird | 150/139 X |
| 3,433,279 | 3/1969 | Seamon | 150/145 X |
| 3,438,415 | 4/1969 | Burniski et al. | 150/145 X |
| 3,734,155 | 5/1973 | Stenger | 150/148 |
| 3,744,541 | 7/1973 | Brauhut | 150/145 X |
| 4,342,350 | 8/1982 | Resnick | 150/138 |
| 4,832,372 | 5/1989 | Young | 150/147 X |
| 5,080,223 | 1/1992 | Mitsuyama | 206/39.5 |

FOREIGN PATENT DOCUMENTS

| | | | |
|---|---|---|---|
| 678376 | 1/1964 | Canada | 150/132 |
| 1214739 | 4/1960 | France | 150/147 |
| 2551330 | 3/1985 | France | 150/147 |
| 1522820 | 10/1969 | Germany | 150/147 |
| 1024111 | 3/1966 | United Kingdom | 150/147 |
| 9104689 | 4/1991 | WIPO | 150/148 |

*Primary Examiner*—Sue A. Weaver
*Attorney, Agent, or Firm*—Gregory J. Nelson

[57] ABSTRACT

A holder for a credit card or a similar object formed from panels at least one of which is transparent and being sealed along selected sides or edges to form a card-receiving pocket. One side is open to insert and receive the card. The opposite side is notched so the user can apply manual force to an edge of a contained card to partially extend it from the pocket. The card holder may be included in an organizer, wallet or pocketbook and may be part of an assembly of card holders joined together.

5 Claims, 4 Drawing Sheets

FIG. 1
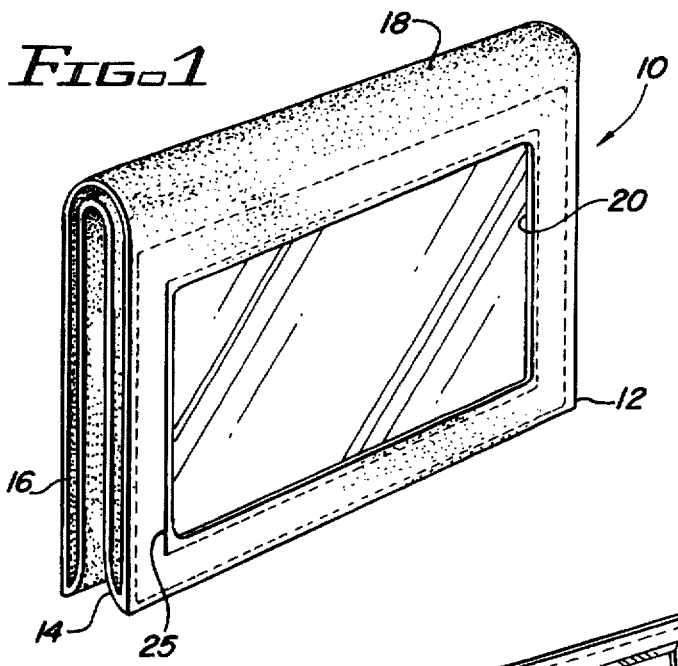
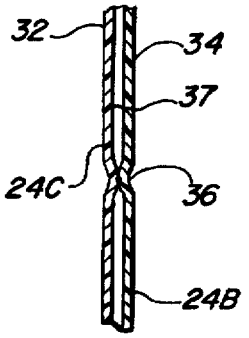
FIG. 3
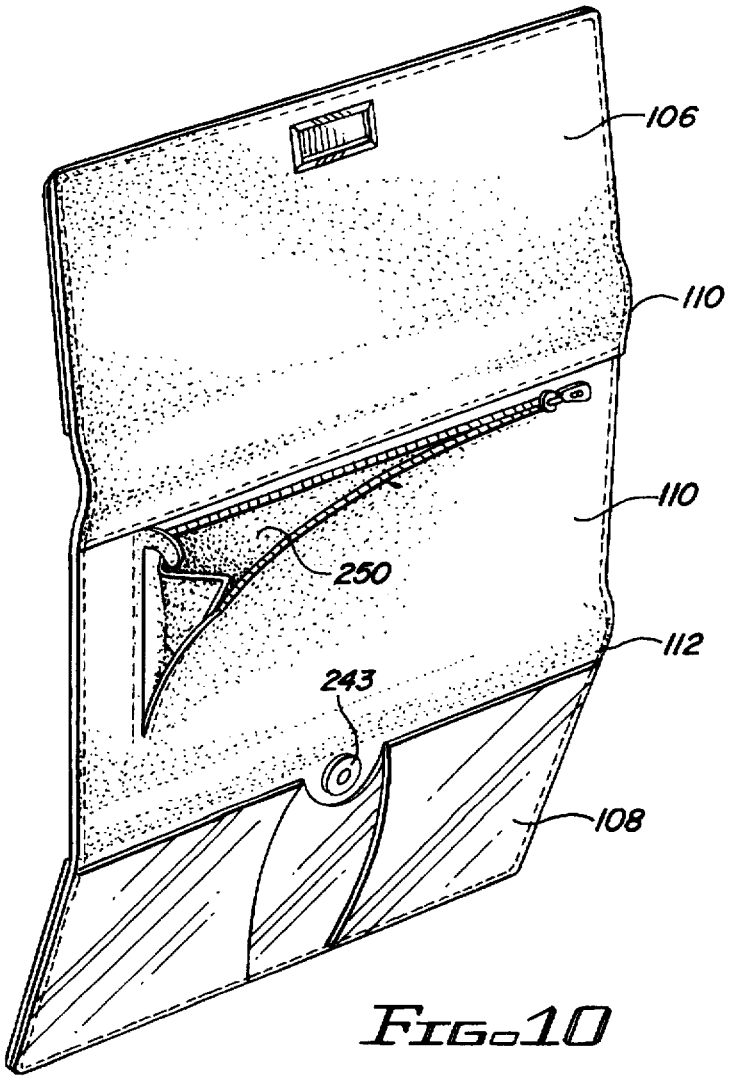
FIG. 10

CARD HOLDER

This is a divisional of application Ser. No. 07/871,195 filed on 4/20/92 now U.S. Pat. No. 5,431,207 Apr. 20, 1992

The present invention relates to card holders or card carrying cases of the type that are carried by individuals to contain credit cards, informational cards, driver's license and the like.

In today's society, the average consumer is required to carry a number of items in card form for various purposes. These types of items include credit cards, driver's license and various identification and informational carrying cards such as insurance identification cards. Normally such cards are carried in purses, wallets and in some type of protector. If the cards are carried loose or not protected, they are subject to being lost and through repeated handling may become bent, scratched and may become illegible or unusable. As a result, various card-carrying cases can be found in the prior art. A variety of such card holders are available for use in connection with wallets and purses.

For example, U. S. Pat. No. 3,759,305 discloses one or more pocket sections of flexible, transparent or translucent plastic which may be provided with one or more card-holding sections. Each of the card-holding sections is provided with a protective flap or closure scored in the facing and ply of the closure and the credit card is inserted in the pocket and retained therein. Card holders such as those exemplified by the above-mentioned patent have been widely used. However, one particular problem with card holders of this general type is that while they serve to retain and protect the card, removal or extrication of the contained card is often difficult.

In an attempt to provide a credit card case which may be conveniently utilized without requiring unusual handling or dexterity, various modifications to credit card cases can be found.

For example, U. S. Pat. No. 3,241,588 shows an assembly for wallets and pass cases having finger-engaging recess.

A similar construction is shown in U. S. Pat. No. 3,537,728 which shows personal card holders having a thumb hold for the card. A further feature is the provision in the window in the pocket so the card may be viewed without removing the card from the pocket.

U.S. Pat. Nos. 4,141,400 and 4,450,955 relate to credit card holders for cards of the type containing or having a magnetic strip thereon. The '955 patent shows a holder that has a back with fold-over lips which receive the edge of the credit card. Finger notches may be provided to aid in grasping the card, removing same from the holder. The '400 patent shows a magnetic holder for magnetic cards having a pocket having internal ribs. A cut-out allows the user to frictionally engage one surface of the card to withdraw it.

While the various holders mentioned above do provide some improvement over the basic type of credit card holder in having provision to facilitate removal of a card, these protective devices still require excessive manipulation and dexterity for removal of the card.

Accordingly, it is a primary object of the present invention to provide a holder for information-bearing cards which holder may be economically produced, is adaptable for inclusion in various types of wallets and organizer cases, provides protection and visibility of the card and still permits the cards to be easily and conveniently removed from the holder.

Briefly, in accordance with the present invention, a card holder is provided which is preferably formed from adjacent panels of transparent material such as a vinyl plastic. The individual panels have opposite sides and top and bottom edges which define a card-receiving pocket. The holder may be glued, stitched or preferably heat sealed along the sides and edges. One of the sides or edges defines an opening through which the card may be inserted and a notch or recess is provided at an opposite side or edge to permit the user to engage an edge of the card with a finger to partially slide the card from the pocket so that the opposite, exposed portion of the card may be easily grasped and re moved by the user. The card holder may be included in a wallet, organizer, or pocketbook assembly and preferably such assembly includes a plurality of such card holders joined edge-to edge, end-to-end, or along a common binding edge.

The above and other objects and advantages of the present invention will become more apparent from the following description, claims and drawings in which:

FIG. 1 is a perspective view of a wallet assembly containing the card holder of the present invention;

FIG. 3 is a sectional view taken along lines 3—3 of FIG. 2;

FIG. 10 is a rear perspective view of the wallet portion of the assembly shown in FIG. 6;

Figure 4A:
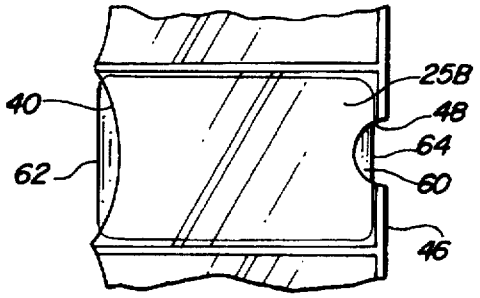
FIGS. 4A through 4C illustrate the sequential steps in removing a contained card from the card holder as shown in FIGS. 1 to 3.

Turning now to the drawings, FIGS. 1 through 5 illustrate the preferred embodiment of the invention shown in connection with a wallet or billfold. The wallet or billfold is generally designated by the numeral 10 and is of conventional construction having an outer panel 12 and an inner panel 14 which define a pocket 16 therebetween for carrying bills, paper currency and the like. The wallet is foldable along a medial fold line 18. The wallet may be constructed from any suitable material such as leather, plastic or the like and is shown of stitched construction. The outer panel 12 defines a cut-out 20 which is generally rectangular having a transparent window 22 therein. An opening 25 provides access to the area beneath the window 22 so an appropriate information card can be inserted. For example, the area beneath window 22 is ideally suited for reception of an identification such as a driver's license allowing the driver's license to be easily inspected for purposes of identification while protecting the license.

Figure 2:
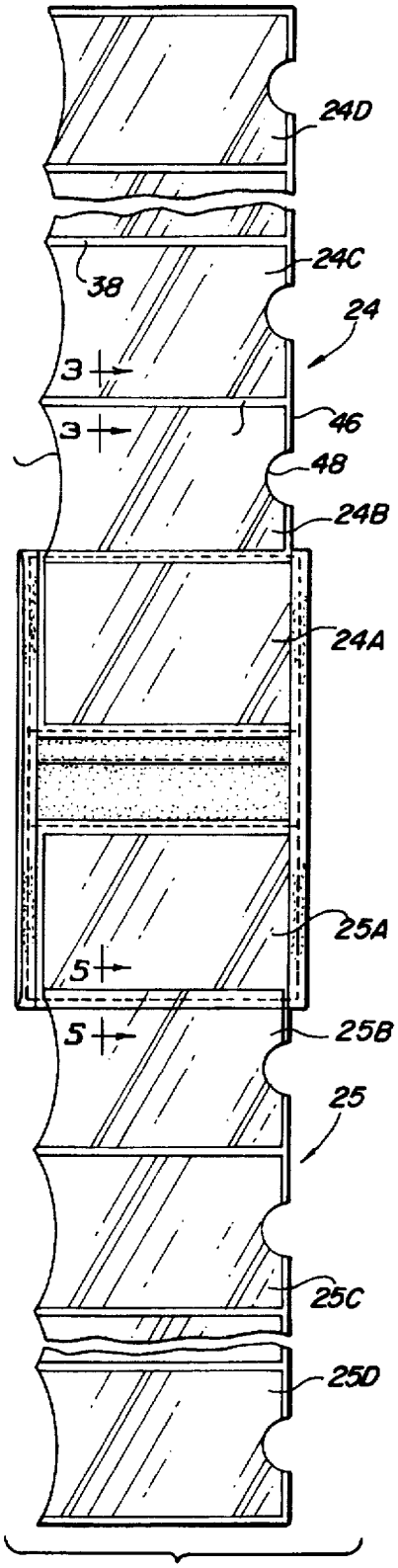
FIG. 2 is a plan view of the wallet of FIG. 1 in an open position with card holder assemblies oppositely extending therefrom.

As best seen in FIG. 2, the wallet assembly incorporates a pair of card holder assemblies 24 and 25 which oppositely unfold from the wallet when the wallet is in an open position as shown. Each of the card assemblies 24 and 25 are substantially identical. For example, assembly 24 comprises a plurality of individual card-receiving sections 24A, 24B, 24C and 24D and assembly 25 includes section 25A, 25B, 25C and 25D. Any convenient number of individual card holders can be included in the assemblies 24 and 25. Each of the holders 24B, 24C, 24D and 25B, 25C and 25D are similarly constructed having opposite panels 32 and 34 which join along opposite edges 36 and 38. Holders 24A and 25A are conventional pockets for receiving various identification cards.

The panels 32 and 34 may be made of various materials but preferably are fabricated from a clear, flexible plastic such as polyvinyl chloride or polyurethane. The edges of the panels are sealed by any convenient means such as bonding, stitching or preferably heat sealing using well-known dielectric heat sealing methods. The individual card holders are generally rectangular in configuration having dimension selected to comfortably receive credit cards and other cards normally carried by users. The left side edges 40 of the holders, as viewed in FIGS. 2 and 4, are not joined together and thus provide an access opening for the interior card-receiving envelope 37. The opposite side edges 46 of the panels are heat sealed or otherwise secured together. A recess or notch 48, which is shown as being generally hemispherical, intersects edge 46 of the holders and is provided through adjacent panels 32 and 34.

Figure 5:
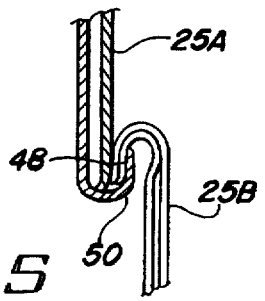
FIG. 5 is a sectional view taken along line 5—5 of FIG. 2.

The card holder assemblies may be permanently or detachably secured to the wallet in any convenient manner. As shown in FIG. 5, a convenient way of securing the assemblies to the wall is by providing an extension edge 48 along the horizontal edge of the card holder 25B. This edge 48 is overlapped by lip 50 formed as part of the edge of the wallet assembly. The edge 48 and lip 50 may be secured together by heat sealing, bonding or stitching.

Thus, as best seen in FIG. 2, when the wallet is opened, the individual card assemblies 24 and 25 may be conveniently expanded to extend from the wallet for purposes of locating a particular credit card, identification card or the like.

Figure 4B:
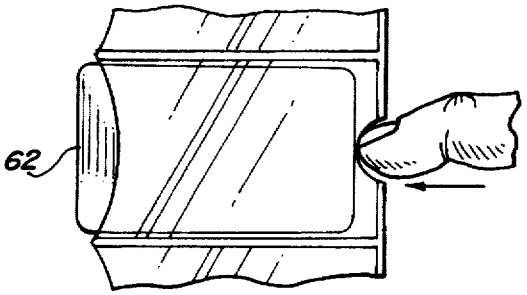
Figure 4C:
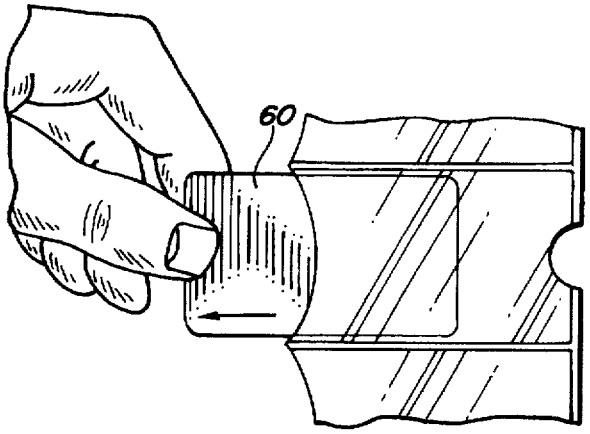

It is often necessary for the user to remove a card from the pocket for payment or identification. As indicated above, this can be a sometimes frustrating experience as conventional plastic and similar credit cards will also often tend to stick to the side walls of the plastic card holder or receptacle. With the card holder of the present invention, extrication of a card from the individual holder is facilitated. As seen in FIGS. 4A to 4C, a credit card 60 is shown in a normal, retained position in, for example, card holder 25B. In the normal position, the left edge 62 of the credit card is slightly exposed inasmuch as card holder sides 40 are concave. Further, recess or notch 48 is provided in the vertical edge 46 exposing a portion of the edge 64 of the credit card. The notch or recess does not extend the full length of the side and is sized to accommodate the end of the finger of the user.

When the user wishes to remove a card, a leftward force is applied to the edge 64 of the credit card at notch 48 as indicated by the arrow in FIG. 4B. Force applied by a finger will slide the card leftwardly so that the left end of the card may be easily grasped by the user, as shown in FIG. 4C. Once grasped, it can be easily removed.

Figure 6:
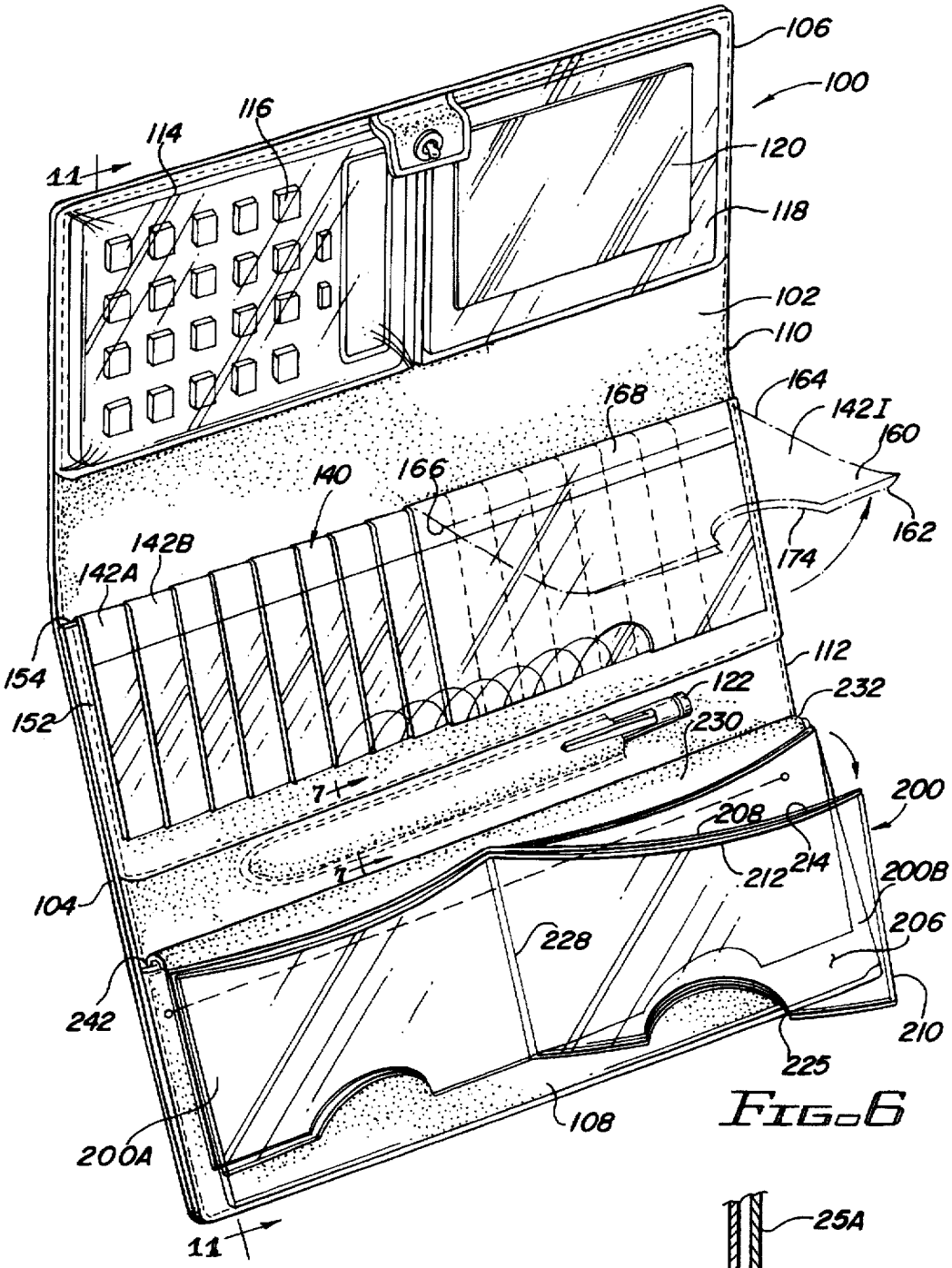
FIG. 6 is a perspective view showing an alternate embodiment of the card case of the present invention shown in connection as part of a trifold wallet assembly.
Figure 7:
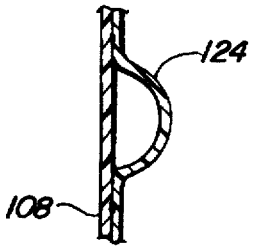
FIG. 7 is a sectional view taken along line 7—7 of FIG. 6.

FIGS. 6 through 11 show an alternate embodiment of the present invention which is generally designated by the numeral 100. In embodiment 100, several embodiments of card holders are shown in conjunction with an organizer 102 of the type generally designated as a trifold wallet. The particular construction of the trifold wallet may vary. The embodiment shown is representative and has an intermediate body section 104, and opposite end sections 106 and 108. Sections 106 and 108 are joined to the intermediate section along fold lines 110 and 112 so that the organizer may be folded into a compact assembly for storage and opened as shown in FIGS. 6 and 10. Section 106 may be variously configured to receive selected accessory items and, as shown, has a pocket 114 for receiving a calculator 116 and an adjacent pocket 118 receiving a mirror 120. Also, as seen in FIGS. 6 and 7, other items such as a pen or pencil 122 may be received in the pocket 124 provided for this purpose.

Intermediate organizer section 104 receives a card holder assembly 140. The assembly 140 is detachably secured to the intermediate organizer section at pocket 152 which has a longitudinally extending upper edge 154. The card holder assembly 140 is provided with a plurality of individual card-receiving holders or sections 142, 142A, 142B, etc. Each of the individual card holders is similarly constructed of a plastic or similar material. Preferably the individual holders are made of a transparent material to provide the identification of the contents. Alternately, the holders may be opaque, if desired. As indicated above, preferred materials are a clear polyvinyl chloride or polyurethane plastic.

Figure 9:
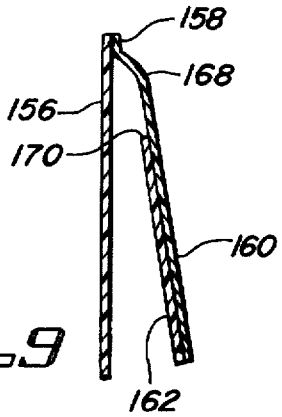
FIG. 9 is a sectional view taken along line 9—9 of FIG. 8.
Figure 8:
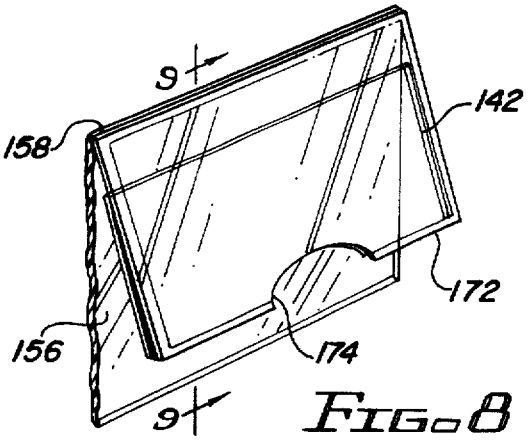
FIG. 8 is a detail view of a single card holder of the type secured along a common binding.

Each of the individual card holders are commonly joined to an insert section 156. As seen in FIGS. 8 and 9, the insert section is generally rectangular and dimensioned so as to be inserted into pocket 152. Insert 156 has an upper longitudinal edge 158 to which the plurality of individual card holders are commonly secured as seen in FIGS. 8 and 9. The individual card holder sections each have an outer panel 160 and an inner panel 162. Panels 160 and 162 are of the same width which approximately corresponds to the width of an item such as a credit card to be inserted between the panels allowing some clearance. The outer panel 160 and inner panel 162 are commonly joined along opposite edges 164 and 166. Referring to FIG. 9, panel 160 has a hinge section 168 which extends beyond the upper edge 170 of panel 162. Hinge section 168 is secured as by heat sealing to the upper horizontal edge of insert 156. An opening is provided along the upper edge 170 of panel 162 and the interior side of panel 160 so that an item may be inserted into the pocket formed therebetween. The lower edges of panels 160 and 162 are sealed along seam or edge 172. A recess or notch 174 is provided through both panels at an intermediate location. Thus, it will be seen that one of the card holders, as for example section 142I, may be lifted upwardly as shown in FIG. 6. A card or other item may be inserted into the pocket along edge 170. In order to remove a card, manual force is applied to the contained item at notch 174 causing it to at least partially extend above upper edge 170 of panel 162 to permit the user to easily grasp the end to remove the item. In the normal contained position, the card or other item is protected within the pocket.

In order to provide receptacles for a plurality of such items, the individual card holders 142, 142A, 142B, etc. are arranged in an overlapping arrangement so a part of each of the individual holders is exposed to the viewer when the organizer is in an open position. This will provide a plurality of leaf-like holders so that the user may quickly inspect the assembly and select the desired card holder by identifying the contents of the pocket through the transparent exposed portion of the card holder.

Figure 12:
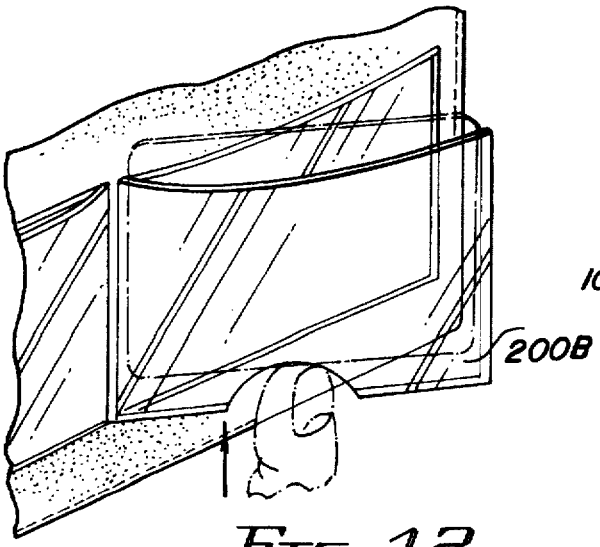
FIG. 12 illustrates removal of a card from a card holder of the type shown in FIGS. 6 and 11.
Figure 11:
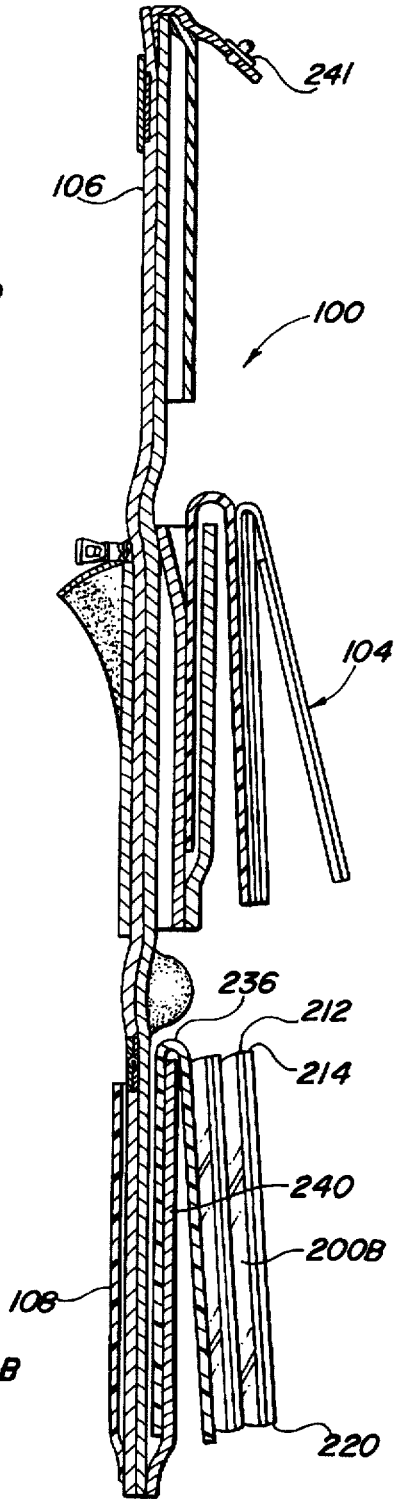
FIG. 11 is a sectional view taken along line 11—11 of FIG. 6.

The organizer in FIG. 6 also incorporates another card holder assembly which is detachably secured to wallet section 108. The card holder is generally designated by the numeral 200 and the assembly consists of a plurality of individual sections 200A, 200B, etc. The card holders 200, 200A, 200B, etc. are similarly constructed and each is fabricated from suitable flexible transparent or opaque material. For example, the card holder 200B has opposite surface panels 206 and 208, each generally rectangular in shape and sized and configured to receive credit cards, identification cards or the like therebetween. The panels are commonly joined along the outer edge 210 at a seam formed by heat bonding or other joining methods. The upper edges 212, 214 of the panels define an opening for insertion and removal of the credit card or other item. Preferably edges 212 and 214 are curved so that an upper edge of the contained item is exposed to facilitate removal. The lower, horizontal edges of panels 206 and 208 are joined at a common sealing line 220. A generally circular notch or recess 225 is positioned at an intermediate location intercepting the lower edge. As indicated in FIG. 12, the notch facilitates removal of a credit card as shown, as it permits the card or other item to be partially extended from the card holder by application of manual pressure through use of a finger.

The interior side edge 228 of each of the card holder pockets are commonly joined to a backing member 228. The holders may be joined at edge 228 by heat sealing or may be retained in place by a mechanical fastener or clip. Edge 228 serves as a binding so that the individual card holders may be turned similar to the pages of a book so the user may locate a desired credit card or item. The backing member 230 is substantially coextensive with organizer section 108 and has a fold line 232 permitting a portion 240 of the backing to be inserted within a pocket 242 formed on the interior of organizer section 108. Thus, the entire credit card holder assembly can easily be withdrawn from the organizer if desired by the user in order to place the assembly and contained items in another purse or other object or for purposes of inspection or changing the contents of the credit card assembly.

The organizer, as indicated above, may be made from any suitable material such as a leather or synthetic material such as vinyl or polyurethane. The trifold organizer construction provides the user with a versatile construction having substantial room for containment of various accessories. The wallet is provided with cooperating closures 241 and 243 which secure the organizer in the closed position. Additional pockets such as pocket 250 may be provided at various locations and provided for the containment of other items such as currency, small change, cosmetics and the like. A zipper closure 252 is shown associated with pocket 250.

Thus, it will be seen the present invention provides a unique holder for various personal items such as credit cards, identification cards and the like. The individual compartments allow the user to readily identify the contents by mere observation. Further, the individual card holders facilitate easy removal of the contents allowing the user to manually apply a force to the contained item causing it to be at least partially extended from the pocket to facilitate removal. Holders may be provided as individual units or may be provided as an assembly or plurality of units arranged in overlapping or similar to pages of a book for economy and efficiency. The credit card holders may be embodied in various types of organizers commonly used in association with credit card holders.

Having thus described my invention, many modifications, alterations and changes will become apparent to those skilled in the art to which it pertains, without departing from the spirit and scope of the appended claims. They are intended to be encompassed therein.

I claim:

1. An organizer for cards comprising:

(a) a first assembly comprising a plurality of card holders each holder having:

(i) a front panel having opposite sides and opposite edges;

(ii) a rear panel having opposite sides and opposite edges and being joined to said front panel along selected opposite edges and sides to define a card-receiving pocket therebetween;

(iii) each of said holders defining a card insertion opening and at least one of said panels being transparent;

(b) an insert member having an edge;

(c) said plurality of card holders each being attached at a hinge along a selected common side to said insert member, whereby a plurality of hinges are formed at said edge, said hinges being positionally fixed with respect to said insert at said edge, said plurality of card holders positioned in overlapping arrangement with at least a part of each card holder exposed when the holders are in said overlapping arrangement to permit viewing of at least part of the contained card and whereby a selected holder may be accessed by grasping the selected holder causing it to be lifted away from said insert at the associated hinge;

(d) one of said panels defining a notch opposite said card insertion opening whereby a manual force may be applied to a contained card by a user's finger at said notch to at least partially extend the card from the pocket at said card insertion opening; and (e) a wallet having a body with a peripheral edge and opposite interior and exterior surface and a first pocket therein for removably receiving said insert, said wallet having an open and a closed position and said card holder remaining in said overlapping arrangement in both said open and closed positions.

2. The organizer of claim 1 wherein said card insertion opening is defined in the rear panel.

3. The organizer of claim 1 further including a second assembly comprising a plurality of card holders each holder having:

(a) (i) a first panel having opposite sides and opposite edges;

(ii) a second panel having opposite sides and edges and being joined to said first panel along selected opposite sides and edges to define a card-receiving pocket therebetween with at least one of said panels being transparent;

(iii) each of said panels defining a card insertion opening therein along one edge and a notch at the opposite edge in at least one panel;

said plurality of card holders being joined at a side and attached to a second insert; and (b) wherein said wallet body is foldable along a fold line between said open and closed position and wherein said wallet body defines a second pocket for removably receiving said second insert.

4. The organizer of claim 3 wherein said wallet body includes third and fourth pockets for accessory items.

5. The organizer of claim 4 wherein said wallet is tri-fold construction.

* * * * *